US012139994B2

(12) United States Patent
Yuan et al.

(10) Patent No.: US 12,139,994 B2
(45) Date of Patent: Nov. 12, 2024

(54) FRAC PLUG DEVICE WITH AN ANCHOR MANDREL ASSEMBLY FOR A LOCKED SET CONFIGURATION

(71) Applicants: CNPC USA Corporation, Houston, TX (US); BEIJING HUAMEI, INC., Beijing (CN); CHINA NATIONAL PETROLEUM CORPORATION, Beijing (CN)

(72) Inventors: Min Mark Yuan, Houston, TX (US); Matthew Patsy, Houston, TX (US); Jianpeng Yue, Houston, TX (US); Peng Cheng, Houston, TX (US); Kwami Roberts, Houston, TX (US)

(73) Assignees: CNPC USA Corporation, Houston, TX (US); Beijing Huamei, Inc., Beijing (CN); China National Petroleum Corporation, Beijing (CN)

( * ) Notice: Subject to any disclaimer, the term of this patent is extended or adjusted under 35 U.S.C. 154(b) by 0 days.

(21) Appl. No.: 18/174,426

(22) Filed: Feb. 24, 2023

(65) Prior Publication Data

US 2024/0287869 A1 Aug. 29, 2024

(51) Int. Cl.
*E21B 33/129* (2006.01)

(52) U.S. Cl.
CPC ..... *E21B 33/129* (2013.01)

(58) Field of Classification Search
CPC ..... E21B 33/124
See application file for complete search history.

(56) References Cited

U.S. PATENT DOCUMENTS

| | | | | |
|---|---|---|---|---|
| 2,627,317 | A | 2/1953 | Baker | |
| 3,298,437 | A | 1/1967 | Conrad | |
| 7,424,909 | B2 * | 9/2008 | Roberts | E21B 33/134 166/118 |
| 8,950,504 | B2 | 2/2015 | Xu et al. | |
| 9,309,733 | B2 | 4/2016 | Xu et al. | |
| 9,835,003 | B2 | 12/2017 | Harris et al. | |
| 10,000,991 | B2 | 6/2018 | Harris et al. | |
| 11,248,435 | B1 * | 2/2022 | Yue | E21B 33/1293 |
| 11,613,740 | B2 * | 3/2023 | Davison | C12Y 301/03008 166/378 |

(Continued)

FOREIGN PATENT DOCUMENTS

WO 2019071084 A1 4/2019

*Primary Examiner* — Taras P Bemko
(74) *Attorney, Agent, or Firm* — Craft Chu PLLC; Andrew W. Chu

(57) ABSTRACT

A ramp type frac plug device of the present invention is a simplified, short and compact frac plug device to both maintain seal to the borehole wall and prevent premature release from the borehole. The frac plug device includes a cone, an anchor assembly, a cap member, a slip device, and a sealing member. In a set configuration, the frac plug device has both the friction fit engagement of the cone and the slip device and a single direction rachet locked engagement of an anchor ring with a threaded ring portion and an anchor mandrel with an exterior threaded mandrel portion of the anchor assembly. The ratchet lock engagement between the anchor ring and the anchor mandrel prevents backward movement of the cone away from the anchor mandrel so that the cap member engaged with the anchor mandrel locks the slip device in position on the cone.

18 Claims, 3 Drawing Sheets

(56) References Cited

U.S. PATENT DOCUMENTS

| | | | | |
|---|---|---|---|---|
| 2013/0186649 | A1 | 7/2013 | Xu et al. | |
| 2013/0299192 | A1 | 11/2013 | Xu et al. | |
| 2015/0060047 | A1* | 3/2015 | Carr | E21B 33/128 166/135 |
| 2018/0171746 | A1 | 6/2018 | Dudzinski et al. | |
| 2018/0171747 | A1 | 6/2018 | Sommers | |
| 2018/0328136 | A1 | 11/2018 | Smith et al. | |
| 2019/0203557 | A1* | 7/2019 | Dirocco | E21B 33/129 |
| 2020/0048981 | A1 | 2/2020 | Coon et al. | |
| 2020/0115990 | A1* | 4/2020 | Patsy | E21B 33/1291 |

* cited by examiner

FRAC PLUG DEVICE WITH AN ANCHOR MANDREL ASSEMBLY FOR A LOCKED SET CONFIGURATION

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to isolating zones in a wellbore. More particularly, the present invention relates a frac plug system that has a run-in configuration to be deployed into a wellbore and a set configuration at a desired location in the wellbore. The frac plug sets a seal for isolating zones in a wellbore. Even more particularly, the present invention relates to a frac plug with a locked set configuration by the anchor mandrel assembly in ratchet locked engagement to prevent premature release of the frac plug device from the desired location.

2. Description of Related Art Including Information Disclosed Under 37 CFR 1.97 and 37 CFR 1.98

Within a wellbore, the hydrocarbons are located at particular depths within a rock formation. These depths can be organized into production zones so that the delivery of production fluids can be targeted to the location of the hydrocarbons. The production fluids facilitate the recovery of the hydrocarbons from the wellbore. Other depth levels do not contain hydrocarbons, which can be called "non-productive zones". There is no need to waste production fluids on non-productive zones without hydrocarbons. Thus, the productive zones are isolated from the non-productive zones for the recovery of hydrocarbons from the wellbore.

There are known downhole tools to separate a production zone from a non-productive zone so that the production fluids can be delivered to the production zone and not the non-productive zone. Examples of downhole tools to isolate zones include a plug, a packer or other tool with an isolation valve.

In the conventional process, the frac plug or frac plug device is run-in to a downhole location. When located in the correct place, the setting tool that traveled with the frac plug device will set the packer, i.e. expand the frac plug against the walls of the borehole. Then, the settling tool is removed. The frac plug still must be activated in order seal the zone. The frac plug is sealed to the borehole, but fluid still flows through the packer. Conventionally, a frac ball is dropped into the borehole. The frac ball travels to the downhole location to sit on a ball seat, which triggers expansion of the frac plug to the borehole walls and can even be incorporated as part of the seal across the frac plug. Fracking can commence with the seal across the packer. The frac fluids are only delivered to the isolated zone, and production fluids are only harvested from the isolated zone.

There are both well known frac plug devices that can be actuated by a frac ball and others that can be actuated by other setting components. U.S. Pat. No. 2,627,317, issued on Feb. 2, 1953 to Baker, discloses a well tester with pre-set frac ball. The frac balls expands the frac plug and forms the seal across the frac plug. U.S. Pat. No. 3,298,437, issued on Jan. 17, 1967 to Conrad, discloses a mandrel assembly as the setting component to expand plug components to the borehole walls by compression and a solid tubular member for the seal across the frac plug.

There are also simplified, compact, and condensed frac plug systems comprised of different material compositions. Fewer components and selection of material composition allow for frac plugs to the removed more easily after use. As the material selection of components is controlled, the use of drilling out removal or the use of dissolving metallic or non-metallic compositions can be selected. As the number of components is reduced, the amount of milling out or the amount of dissolving chemicals can be reduced. Some of these simplified and condensed frac plug systems are wedge type or ramp type frac plug systems comprised of a wedge or ramp, a sealing ring, and a slip device. There are limitations to the functional properties of the components of the frac plug device, depending on the material composition of the components. Components of non-metallic composite materials are brittle and cannot be machined to the same sharpness and hardness as metallic materials.

Various patents and publications have been granted for wedge type or ramp type frac plug systems. US Patent Publication No. 20130299192, published on Nov. 14, 2013 for Xu et al and granted as U.S. Pat. No. 8,950,504, discloses a plug comprised of a frustoconical member, a slip or sleeve that expands to the borehole wall, and a seal at the tip of the slip. The selected material composition is metal composite. US Patent Publication No. 20130186649, published on Jul. 25, 2013 for Xu et al and granted as U.S. Pat. No. 9,309,733, discloses a plug comprised of a cone removably attached to a mandrel, a slip or sleeve that expands to the borehole wall, and a seal at the tip of the slip. The selected material composition is metal composite. The mandrel pushes the cone to expand the slip and releases from the cone, when the plug is set. U.S. Pat. No. 10,000,991, issued on Jun. 19, 2018 to Harris et al, discloses a plug comprised of an annular wedge with collet fingers, an annular slip, and a sealing ring. U.S. Pat. No. 10,000,991, issued on Jun. 19, 2018 to Harris et al, discloses a plug comprised of an annular wedge with collet fingers, an annular slip, and a sealing ring. U.S. Pat. No. 9,835,003, issued on Dec. 5, 2017 to Harris et al, discloses a non-metallic composite annular wedge, annular slip, and a sealing ring.

There is a need for increased reliability of these known simplified wedge type or ramp type frac plugs. The friction fit setting of the single set of wedge and slip engagement is directional. Without a second set of wedge and slip engagement to the borehole wall in the opposite direction, the simplified wedge type or ramp type frac plugs rely on frictional engagement between the one wedge or cone and the one slip device. Forces in the opposite direction may dislodge and release the frac plug. Any pressure pulse or waiver in directional pressure may loosen and affect the integrity of the seal of these simplified wedge type or ramp type frac plugs. There is also a need for an assembly to increase reliability for components of both non-metallic composite materials and metallic composite materials.

It is an object of the present invention to provide a frac plug device to isolate zones in a wellbore.

It is an object of the present invention to provide a simplified short frac plug device to maintain seal to the borehole wall and to prevent premature release from the borehole.

It is another object of the present invention to provide a simplified short frac plug device with composite components to maintain seal to the borehole wall and to prevent premature release from the borehole.

It is an object of the present invention to provide a frac plug device having a threaded ring portion of an anchor ring within a cone and an anchor mandrel with an exterior threaded mandrel portion cooperative with the threaded ring portion.

It is another object of the present invention to provide a frac plug device having a threaded ring portion of an anchor ring within a non-metallic composite cone and a dissolvable metal anchor mandrel with an exterior threaded mandrel portion.

It is an object of the present invention to provide a simplified short frac plug device set by friction between the cone and the slip device and single direction ratchet locking threaded engagement between the threaded ring portion of an anchor ring within the cone and the anchor mandrel.

It is another object of the present invention to provide a simplified short frac plug device to prevent premature release of cone from the slip.

It is another object of the present invention to provide a simplified short frac plug device to maintain the seal to the borehole by friction between the cone and the slip device and ratchet locking threaded engagement between the threaded ring portion of an anchor ring within the cone and the anchor mandrel.

These and other objectives and advantages of the present invention will become apparent from a reading of the attached specification, drawings and claims.

BRIEF SUMMARY OF THE INVENTION

Embodiments of the present invention include a simplified, short, and compact wedge type or ramp type frac plug device that locks the set configuration to maintain the seal in the wellbore and prevent premature release of the cone from the slip device. The frac plug device includes a cone, an anchor mandrel assembly, a cap member, a slip device, and a sealing member. The frac plug device has a run-in configuration for the deployment into the wellbore and a set configuration at the desired location so that the wellbore is sealed at the desired location. In the set configuration, the frac plug device has both the friction fit engagement of the cone and the slip device and a single direction rachet locked engagement of the anchor mandrel assembly to lock the friction fit engagement of the cone and slip device.

The cone of the frac plug device of the present invention includes an inner core with an inner ring groove near a second cone end and a tapered outer surface decreasing in outer cone diameter toward the second cone end. The tapered outer surface is compatible with the slip device and the sealing member. The inner ring groove is dimensioned to hold the anchor mandrel assembly in the ratchet locked engagement in both the run-in and the set configurations of the frac plug device.

Embodiments of the anchor mandrel assembly includes an anchor mandrel and an anchor ring. The anchor mandrel has an exterior threaded mandrel portion at a first anchor mandrel end. In a particular embodiment, the anchor mandrel is comprised of a plurality of collet fingers and a collet base. The collet fingers extend from the collet base toward the cone. The exterior threaded mandrel portion can be comprised of each exterior collet finger surface of the plurality of collet fingers. The anchor ring within the inner ring groove of the cone has a threaded ring portion. The threaded ring portion and the exterior threaded mandrel portion are in ratchet locked engagement that restricts movement of the anchor mandrel toward anchor ring within the cone. The anchor mandrel assembly components with threads are comprised of a metal material and may be dissolvable or non-dissolvable metal. Other components, such as the cone, can now be comprised of composite materials, including non-metallic composite materials.

A tapered inner surface of the slip device is in sliding engagement with the tapered outer surface of the cone according to the threaded ring portion of the anchor ring within the cone in ratchet locked engagement with the exterior threaded mandrel portion of the anchor mandrel. The present invention has a locked set configuration to prevent the release of the seal of the frac plug device at the desired location in the wellbore. The locking of the set configuration is achieved in the same setting action in the same direction as transitioning from the run-in configuration to the set configuration.

The anchor mandrel is removably engaged to the cap member. The cap member is engaged with the anchor mandrel, while a first cap end faces the slip device. In the locked set configuration, the anchor ring within the cone and the anchor mandrel are in a ratchet locked position with the cap member holding the slip device in the extended position. The slip device is prevented from retracting back to the initial position. The cap member exerts pressure against the slip device so as to prevent release of the slip device from the cone.

The frac plug device can also comprise a seal support ring between the sealing member and the slip device to strengthen the seal of the frac plug device in the locked set configuration and prevent extrusion of the sealing member. The seal support ring is similarly expandable in diameter in the transition from the run-in configuration to the locked set configuration of the present invention. Other embodiments include the tapered outer surface being comprised of a notch so as to engage the sealing member for support and stabilization of the seal of the frac plug device in the locked set configuration.

Embodiments of the present invention further include a method of isolating a zone in a wellbore with the frac plug device. The method comprises the steps of deploying the frac plug device in the run-in configuration with the anchor ring within cone and the anchor mandrel at a first ratchet locked position; moving the threaded ring portion along the exterior threaded mandrel portion from the first ratchet locked position toward a second ratchet locked position closer to the first cone end; and pushing the tapered inner surface along the tapered outer surface with the cap member against the second slip end. The method further includes placing the frac plug device in the set configuration with the anchor ring within the cone and the anchor mandrel at the second ratchet locked position. The set configuration is a locked set configuration with the ratchet lock engagement of the anchor ring within the cone and the anchor mandrel holding the cap member against the slip device to prevent retraction of the slip device. In the set configuration, the method further includes setting the slip device in a borehole wall with the outer engagement surface in the extended position and sealing the sealing member in the expanded position against the borehole wall.

DETAILED DESCRIPTION OF THE INVENTION

Figure 1:
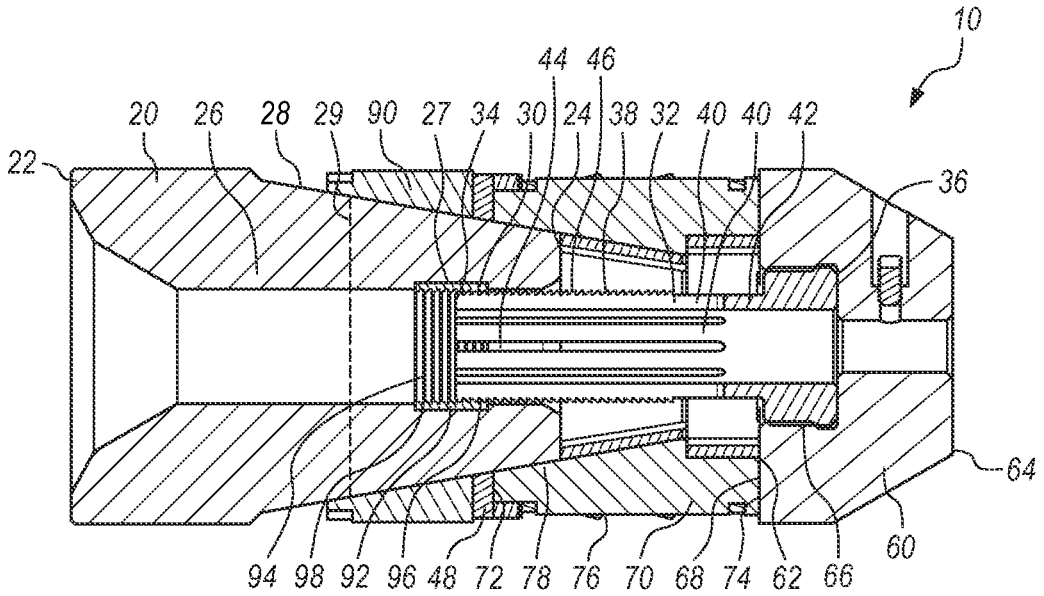
FIG. 1 is a sectional view of an embodiment of the frac plug device, according to the present invention and showing the frac plug device in a run-in configuration.
Figure 2:
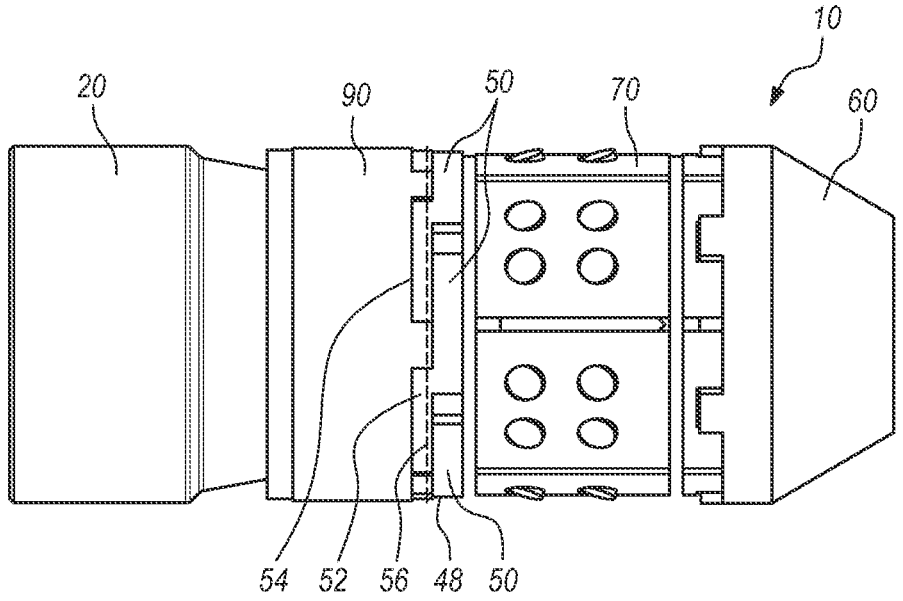
FIG. 2 is a side elevation view of the embodiment of the frac plug device in the run-in configuration, as in FIG. 1.

Wedge type or ramp type frac plugs are simplified, short and compact. These qualities make ramp type frac plugs popular for being easy to use and quick to set. There is a single direction setting that relies on simple friction between the tapered outer surface of a wedge or cone and the complementary tapered inner surface of a slip device. A serious consequence of this simple single direction setting is a similarly simple single direction unsetting. Just as easily and quickly the ramp type frac plug can be set, the ramp type frac plug can be unset with the loss of friction fit engagement of the tapered inner surface of the slip device against the tapered outer surface of the cone. Forces in the opposite direction of the single direction for setting, even jostling vibration, may release the cone from the slip device or degrade the friction fit engagement, which releases or at least reduces the integrity of the seal against the borehole by the frac plug. The present invention is a ramp type frac plug device 10 that locks the cone and the slip device in the set configuration in addition to the friction fit engagement of the cone and the slip device. The present invention is a frac plug device 10 with an anchor mandrel assembly 30 compatible with both metallic and non-metallic composite materials of the frac plug device 10.

The frac plug device 10 of the present invention include a cone 20, an anchor mandrel assembly 30, a cap member 60, a slip device 70, and a sealing member 90, as shown in FIGS. 1-8. The frac plug device 10 has a run-in configuration for the deployment into the wellbore. In the run-in configuration, the frac plug device 10 is condensed and thin. When the frac plug device 10 reaches a desired location within the wellbore, the frac plug device 10 is triggered to expand within the wellbore. The frac plug device 10 has a set configuration at the desired location so that the wellbore is sealed at the desired location. In the set configuration, the frac plug device 10 has both the friction fit engagement of the cone 20 and the slip device 70 and a rachet locked engagement of the anchor mandrel assembly 30. The ratchet locked engagement can hold the cone 20 to the slip device 70, even if the cone 20 is comprised of composite materials. The ramp type frac plug device 10 of the present invention has a more reliable and durable seal for a ramp type frac plug device.

FIGS. 1-6 show embodiments of the cone 20 of the frac plug device 10 having first cone end 22 and a second cone end 24 opposite the first cone end 20. The cone 20 also includes an inner core 26 extending from the first cone end 22 to the second cone end 24 and a tapered outer surface 28 decreasing in outer cone diameter 29 toward the second cone end 24. FIGS. 1 and 3-6 show tapered outer surface 28 at its smallest diameter at the second cone end 24. The cone taper angle can extend from the second cone end 24 to the first cone end 22 or reach a largest diameter before the first cone end 22 as shown in FIGS. 1 and 3-6. The present invention includes any cone taper angle for tapered outer surface 28. The present invention only requires the tapered outer surface 28 to be compatible with the slip device 70 and sealing member 90.

Figure 3:
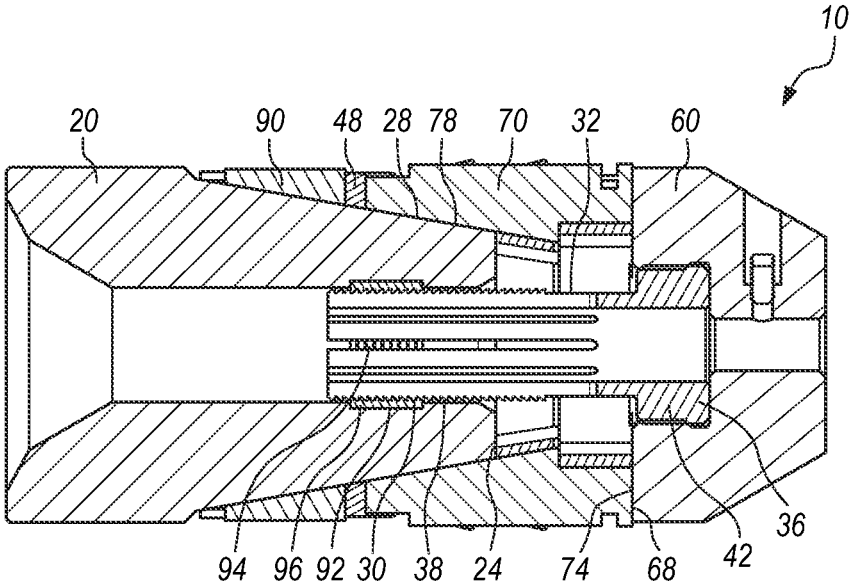
FIG. 3 is a sectional view of an embodiment of the frac plug device, according to the present invention and showing the frac plug device between the run-in configuration and a set configuration.
Figure 4:
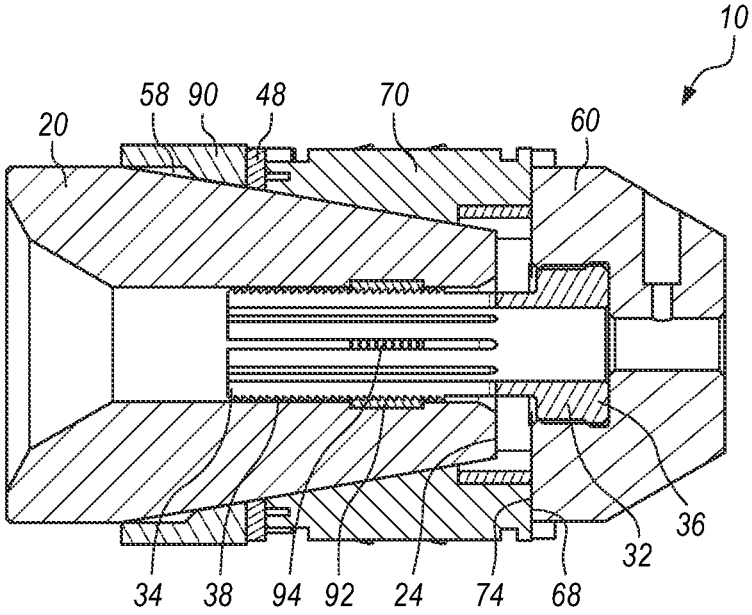
FIG. 4 is a sectional view of an embodiment of the frac plug device, according to the present invention and showing the frac plug device in the set configuration with the ratchet locked engagement of the threaded ring portion of an anchor ring within the cone and anchor mandrel.
Figure 5:
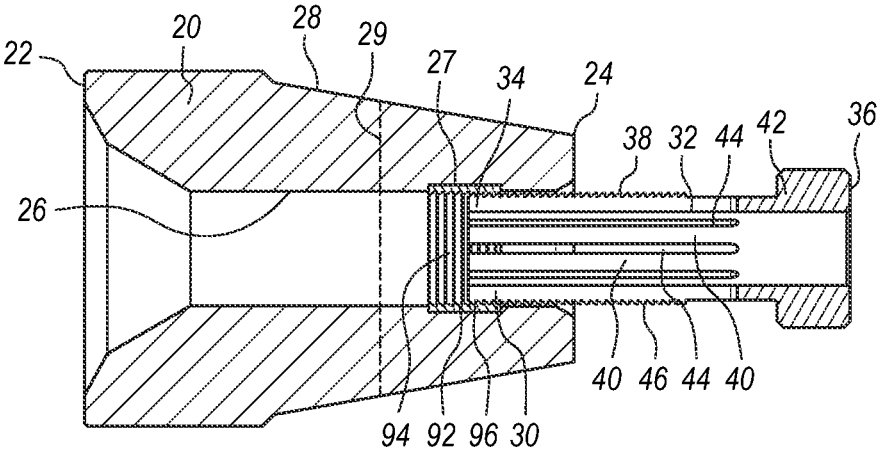
FIG. 5 is an isolated sectional view of embodiments of the threaded ring portion of an anchor ring within the cone and anchor mandrel of the present invention in the run-in configuration of FIG. 1.
Figure 6:
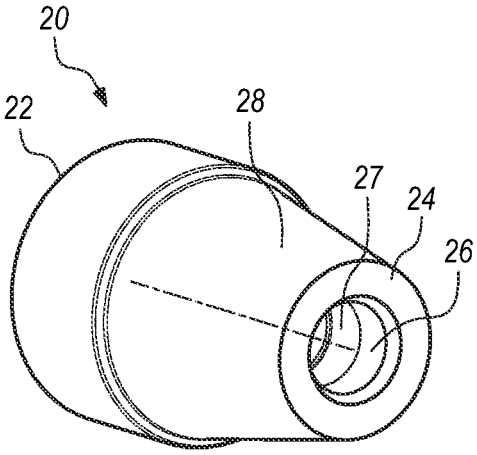
FIG. 6 is a front perspective view of an embodiment of the cone of the frac plug device of the present invention.

FIGS. 1 and 3-6 show that the inner core 26 is comprised of an inner ring groove 27 closer to the second cone end 24 than the first cone end 22. In this embodiment, the inner ring groove 27 extends about halfway through the cone 20 from the second cone end 24 toward the first cone end 22. The inner ring groove 27 can be just a portion of the inner core 26. The present invention can also include the inner ring groove 27 extending all the way from the second cone end 24 to the first cone end 22. The inner ring groove 27 must be sufficiently dimensioned to hold the anchor mandrel assembly 30 to the cone 20 in the ratchet locked engagement both in the run-in configuration and in the set configuration of the frac plug device 10. FIG. 5 shows an embodiment of the inner ring groove 27 being within the tapered outer surface 28 of the cone 20.

FIGS. 1, and 3-8 show embodiments of the anchor mandrel assembly 30 attached to the cone 20. The anchor mandrel assembly 30 is comprised of: an anchor mandrel 32 having a first anchor mandrel end 34, a second anchor mandrel end 36 opposite the first anchor mandrel end 34, and an exterior threaded mandrel portion 38 at the first anchor mandrel end 34; and an anchor ring 92 having a threaded ring portion 94. The anchor ring 92 is contained in the inner ring groove 27 of the cone 20. The anchor ring 92 is fitted to the inner ring groove 27 to hold the anchor ring 92 within the cone 20 and without any movement within the inner core 26 of the cone 20. The anchor mandrel 32 can move relative to the cone 20, even as the anchor ring 92 remains in the same position within the cone 20. The threaded ring portion 94 is in ratchet locked engagement with the exterior threaded mandrel portion 38 of the anchor mandrel 32. The ratchet locked engagement is in a single direction so that the anchor mandrel 32 cannot move away from the anchor ring 92 within the cone 20. The anchor mandrel 32 can only move toward the first cone end 22 through the anchor ring 92. The threaded ring portion 94 must be sufficiently dimensioned to hold the anchor mandrel 32 in the ratchet locked engagement both in the run-in configuration and in the set configuration of the frac plug device 10. The anchor mandrel 32 cannot shift or wiggle in the set configuration of the frac plug device 10. FIG. 5 shows an embodiment of the threaded ring portion 94 being about a quarter of the exterior threaded mandrel portion 38.

Figure 8:
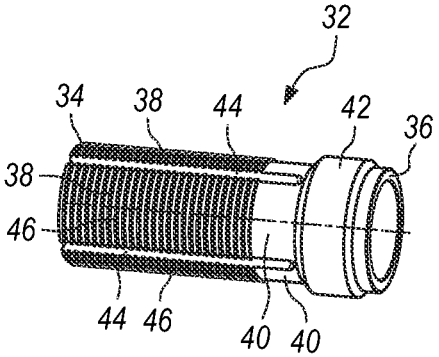
FIG. 8 is a side perspective view of an embodiment of the anchor mandrel of the anchor mandrel assembly in the frac plug device of the present invention.

In some embodiments, the anchor mandrel 32 is comprised of a plurality of collet fingers 40 and a collet base 42. The collet base 42 is on the second anchor mandrel end 36, and the collet fingers 40 extend from the collet base 42 toward the first anchor mandrel end 34 and toward the cone 20. There can also be a plurality of slots 44 between adjacent collet fingers 40 of the plurality of collet fingers 40. FIG. 8 shows the exterior threaded mandrel portion 38 being comprised of each exterior collet finger surface 46 of the plurality of collet fingers 40. The collet fingers 40 have free collet finger ends that allow the ratchet locked engagement of the anchor mandrel 32 and the cone 20. The ratchet locked engagement restricts movement of the anchor mandrel 32 toward the anchor ring 92 within the cone 20. The ratchet locked engagement of the exterior threaded mandrel portion 38 and the threaded ring portion 94 prevent movement of the anchor mandrel 32 away from anchor ring 92 within the cone 20. The collet fingers 40 are only one embodiment of the exterior threaded mandrel portion 38 being in ratchet locked engagement with the anchor ring 92 within the cone 20. The position of the anchor mandrel 32 relative to the anchor ring 94 determines the position of the anchor mandrel 32 relative to the cone 20 because the anchor ring 92 is contained in the inner ring groove 27 of the cone 20.

Figure 7:
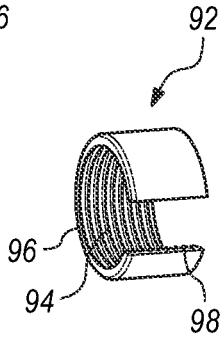
FIG. 7 is a front perspective view of an embodiment of the anchor ring of the anchor mandrel assembly in the frac plug device of the present invention.

Embodiment of the anchor ring 92 include an annular shape or a C-shape. The C-shape can be easier to install within the inner ring groove 27. As long as the dimensions are large enough, the threads of the threaded ring portion 94 of a C-shape can be sufficient for the ratchet locked engagement to the anchor mandrel 32. The threaded ring portion 94 covers at least a portion 96 of the inner ring surface 98 of the anchor ring 92. Again, the threads of the threaded ring portion 94 on a portion 96 of the inner ring surface 98 can be sufficient for the ratchet locked engagement to the anchor mandrel 92. FIG. 7 shows the threaded ring portion 94 covering all of the inner ring surface 98 in one embodiment.

In the present invention, the cone 20, the anchor mandrel assembly 30, and the slip device 70 can be fabricated of a metal material or composite materials. Metal materials, including but not limited to metal composite, dissolvable metal, and non-dissolvable metal, can be manufactured with threads. Threads with the required sharp edges and resistance to deformation for the single direction ratchet locked engagement of the present invention are preferably comprised of metal compositions, dissolvable or non-dissolvable. With dissolvable metal material, the frac plug device 10 can be removed with chemical compositions injected into the wellbore. With non-dissolvable metal materials, the frac plug device 10 may require conventional milling or drilling out for removal. For composite materials, particularly non-metallic composite materials, threads cannot be reliably fabricated in any components. Threads in a non-metallic composite material are brittle and cannot reliably hold the edges of threads. Any threads in non-metallic composite materials degrade too easily. In the present invention, the cone 20 can be comprised non-metallic composite materials, as long as the anchor mandrel assembly 30 (the anchor mandrel 32 and the anchor ring 92) are comprised of metallic composite materials or metal materials. The slip device 70 can be any compatible material for the sliding friction fit engagement between the tapered outer surface 28 of the cone 20 and a tapered inner surface 78 of the slip device 70. The non-metallic composite cone 20 of the present invention with the inner ring groove 27 enables the threaded ring portion 94 of the anchor ring 92 within the inner ring groove 27 in ratchet locked engagement with the anchor mandrel 32 to position the cone 20 relative to the anchor mandrel 32.

FIGS. 1-4 further show the cap member 60 having a first cap end 62 and a second cap end 64 opposite the first cap end 62. The cap member 60 is engaged with the second anchor mandrel end 36. The slip device 70 has a first slip end 72 and a second slip end 74 opposite the first slip end 72. The slip device 70 is comprised of an outer engagement surface 76, and a tapered inner surface 78 increasing in diameter to the first slip end 72. The first cap end 62 faces the second slip end 74. The slip taper angle of the tapered inner surface 78 is compatible with the cone taper angle of the tapered outer surface 28 for friction fit engagement. FIGS. 1-4 further show the sealing member 90 being mounted around the tapered outer surface 28. The slip device 70 is between the sealing member 90 and the cap member 60.

In the present invention, the tapered inner surface 78 of the slip device 70 is in sliding engagement with the tapered outer surface 28 of the cone 20 according to the threaded ring portion 94 within the cone 20 in ratchet locked engagement with the exterior threaded mandrel portion 38 of the anchor mandrel 32. The present invention has a locked set configuration to prevent the release of the seal of the frac plug device 10 at the desired location in the wellbore. The set configuration of the prior art ramp type frac plugs lack the additional support and redundancy to maintain the set configuration. There is more than friction to prevent the slip device from releasing the cone. The frac plug device 10 remains a ramp type frac plug that is still simple and compact. The locking of the set configuration is achieved in the same setting action as transitioning from the run-in configuration to the set configuration. The locking is achieved with the same direction of movement of the cone 20 toward the slip device 70 as transitioning from the run-in configuration to the set configuration.

FIGS. 1, 3 and 4 show the transition from the run-in configuration of the frac plug device 10 in FIG. 1 (and FIG. 2) to the set configuration of the frac plug device 10 in FIG. 4. The set configuration of FIG. 4 is a locked set configuration. In the run-in configuration of FIG. 1 and FIG. 2, the threaded ring portion 94 within the cone 20 is at a first ratchet locked position relative to the exterior threaded mandrel portion 38 of the anchor mandrel 32, the slip device 70 being in an initial position, and the sealing member 90 being in an original position. The slip device 70 and the sealing member 90 are in the most compressed and smallest dimension. The run-in configuration is easier to maneuver through the wellbore to the desired location. The frac plug device 10 has its smallest overall diameter in this run-in configuration. In the set configuration of FIG. 4, the threaded ring portion 94 within the cone 20 is at a second ratchet locked position relative to the exterior threaded mandrel portion 38 of the anchor mandrel 32, the slip device 70 being in an extended position, and the sealing member 90 being in an expanded position. FIG. 3 shows the threaded ring portion 94 within the cone 20 moving from the first ratchet locked position to the second ratchet locked position relative to the exterior threaded mandrel portion 38 of the anchor mandrel 32.

The first anchor mandrel end 34 is closer to the first cone end 22 in the second ratchet locked position than in the first ratchet locked position. The second ratchet locked position must be sufficient for the threaded ring portion 94 within the cone 20 to anchor the anchor mandrel 32 so that the anchor mandrel 32 cannot shift or wiggle in the set configuration of the frac plug device 10. Thus, the set configuration of the frac plug device 10 is a locked set configuration. Consistent with transition from the run-in configuration to the set configuration, the outer engagement surface 76 of the slip device 70 is moved to the extended position so as to hold the slip device 70 in the borehole wall, and the sealing member 90 is in the expanded position so as to seal against the borehole wall. The slip device 70 and the sealing member 90 are at their largest diameters in the set configuration, which is a locked set configuration for the frac plug device 10 of the present invention.

The embodiments of FIGS. 1, 3 and 4 show the anchor mandrel 32 removably engaged to the cap member 60. The cap member 60 is engaged with the second anchor mandrel end 36, while the first cap end 62 faces the second slip end 74. When threaded ring portion 94 within the cone 20 and the anchor mandrel 32 are in the second ratchet locked position, the cap member 60 holds the slip device 70 in the extended position and prevents the slip device 70 from retracting back to the initial position. The cap member 60 exerts pressure against the second slip end 74 so as to prevent release of the slip device 70 from the cone 20.

An embodiment of the cap member 60 in FIGS. 1-4 is comprised of a cap cavity 66 on the first cap end 62. In this embodiment, the second anchor mandrel end 36 is mounted in the cap cavity 66. The cap member 60 can be comprised of a first cap end surface 68 engaged with the second slip end 74.

The frac plug device 10 can also comprise a seal support ring 48 between the sealing member 90 and the slip device 70. The seal support ring 48 is an additional component to strengthen the seal of the frac plug device 10 in the locked set configuration of the present invention. The seal support ring 48 can additionally prevent extrusion of the sealing member 90, depending on the material composition of the sealing member 90. FIGS. 1-4 show the seal support ring 48 being comprised of a plurality of ring segments 50. Each ring segment 52 of the plurality of ring segments overlaps an adjacent ring segment 54 of the plurality of ring segments so as to support the sealing member 90. The seal support ring 48 increase durability of the sealing member 90 and can prevent the sealing member 90 from extruding toward the slip device 70. The seal support ring 48 is similarly expandable in diameter in the transition from the run-in configuration to the locked set configuration of the present invention. Each ring segment 52 of the plurality of ring segments 50 is less overlapped with an adjacent ring segment 54 of the plurality of ring segments as a seal support ring diameter 56 increases from the run-in configuration to the set configuration.

FIG. 4 shows a further embodiment of the cone 20, wherein the tapered outer surface 28 is comprised of a notch 58 between the first cone end 22 and the second cone end 24 so as to engage the sealing member 90 in the expanded position. The notch 58 can further support and stabilize the seal of the frac plug device 10 in the locked set configuration of the present invention.

Embodiments of the present invention further include a method of isolating a zone in a wellbore with the frac plug device 10. The method comprises the step of deploying the frac plug device 10 in the run-in configuration with the anchor ring 92 within the cone 20 and the anchor mandrel 32 at a first ratchet locked position, the slip device 70 in the initial position, and the sealing member 90 in the original position. Next, the method includes moving the threaded ring portion 94 of the anchor ring 92 along the exterior threaded mandrel portion 38 from the first ratchet locked position toward a second ratchet locked position closer to the first cone end 22 and pushing the tapered inner surface 78 along the tapered outer surface 28 with the cap member 60 against the second slip end 74. The method further includes placing the frac plug device 10 in the set configuration with the anchor ring 92 within the cone 20 and the anchor mandrel 32 at the second ratchet locked position, the slip device 70 in the extended position, and the sealing member 90 in the expanded position. The set configuration is a locked set configuration with the ratchet lock engagement of the anchor ring 92 within the cone 20 and the anchor mandrel 32 holding the cap member 60 against the slip device 70 to prevent retraction of the slip device 70.

In the set configuration, the method further includes setting the slip device 70 in a borehole wall with the outer engagement surface 76 in the extended position and sealing the sealing member 90 in the expanded position against the borehole wall. The slip device 70 and the sealing member 90 are at larger diameters than in the run-in configuration.

Embodiments of the method of the present invention also include the anchor mandrel 32 being comprised of a plurality of collet fingers 40 and a collet base 42. The collet base 42 is on the second anchor mandrel end 36, and the collet fingers 40 extend from the collet base 42 toward the first anchor mandrel end 34 and toward the cone 20. The step of moving the threaded ring portion 94 at the first ratchet locked position toward the second ratchet locked position is further comprised of bending each collet finger 40 and restoring each collet finger 40. There is a snap fit action for the ratchet lock engagement between the threaded ring portion 94 and the exterior threaded mandrel portion 38. The individual threaded are oriented in one direction so that the threaded ring portion 94 cannot move backwards against the exterior threaded mandrel portion 38 toward the first ratchet locked position. FIGS. 1, 3 and 4 show an embodiment of the exterior threaded mandrel portion 38 being comprised of each exterior collet finger surface 46 of the plurality of collet fingers 40.

An alternate embodiment of the present invention includes the frac plug device 10 comprising a seal support ring 48 between the sealing member 90 and the slip device 70. In this embodiment of FIGS. 1-4, the seal support ring 48 is comprised of a plurality of ring segments 50. Each ring segment 52 of the plurality of ring segments 50 overlaps an adjacent ring segment 54 of the plurality of ring segments 50. In the method of the present invention, the step of placing the frac plug device 10 in the set configuration further comprises the step of expanding the seal support ring 48 so as to prevent the sealing member 90 from extruding toward the slip device 70. In some embodiments, the step of expanding is comprised of reducing overlap of each ring segment 52 of the plurality of ring segments 50 with an adjacent ring segment 54 of the plurality of ring segments 50 as a seal support ring diameter 56 increases.

In the embodiments of the tapered outer surface 28 being comprised of a notch 58 between the first cone end 22 and the second cone end 24, the step of placing the cone in the set configuration, the slip device in the extended position, and the sealing member in the expanded position further comprises the step of engaging the sealing member 90 in the expanded position to the notch 58. The notch 58 and the cap member 70 further lock the sealing member 90 in the expanded position and the slip device 70 in the extended position. The cone 20 and slip device 70 are anchored by more than friction fit engagement between tapered surfaces and resist release of the cone 20 from the slip device 70.

The frac plug device of the present invention isolates zones in a wellbore. The present invention is a ramp type frac plug that is still a simplified short and compact frac plug device to both maintain seal to the borehole wall and prevent premature release from the borehole. The frac plug device has an anchor ring with a threaded ring portion and an anchor mandrel with an exterior threaded mandrel portion cooperative with the threaded cone portion. The anchor ring is contained in the cone, and the cap member is attached to the anchor mandrel, so that the ratchet lock engagement between the anchor ring and the anchor mandrel of the anchor mandrel assembly prevents backward movement of the cone away from the anchor mandrel. The cap member engaged with the anchor mandrel locks the slip device in position on the cone. The threaded ring portion of the anchor ring being separate from the cone enables the cone to be comprised of composite materials. The frag plug device of the present invention has a set configuration that is a locked set configuration with more resilience and reliability.

The frac plug device of the present invention includes a dissolvable metal anchor ring with a threaded ring portion and a dissolvable metal anchor mandrel with an exterior threaded mandrel portion. The single direction ratchet locked engagement between the anchor ring and the anchor mandrel is reliable and able to be manufactured concurrent with other simplified and compact components for a ramp type frac plug device. The cone can now be comprised of non-metallic composite material. The slip device can be comprised of any compatible material for the friction fit engagement with the cone. The set configuration of the frac plug device is no longer determined by a friction fit engagement between tapered surfaces of the cone and the slip device. The set configuration of the present invention is a locked set configuration by both the friction fit engagement between the cone and the slip device and the single direction ratchet locking threaded engagement between the anchor ring within the cone and the anchor mandrel attached to the cap member. The simplified short frac plug device of the present invention has the locked set configuration to prevent premature release of cone from the slip and to maintain the seal to the borehole by friction between the cone and the slip device and ratchet locking threaded engagement between the anchor ring within the cone and the anchor mandrel.

The foregoing disclosure and description of the invention is illustrative and explanatory thereof. Various changes in the details of the illustrated structures, construction and method can be made without departing from the true spirit of the invention.

We claim:

1. A frac plug device, comprising:

a cone having first cone end, a second cone end opposite said first cone end, an inner core extending from said first cone end to said second cone end, and a tapered outer surface decreasing in outer cone diameter toward said second cone end, wherein said inner core is comprised of an inner ring groove closer to said second cone end than said first cone end;

an anchor mandrel assembly attached to said cone, wherein said anchor mandrel assembly is comprised of:

an anchor mandrel having a first anchor mandrel end, a second anchor mandrel end opposite said first anchor mandrel end, and an exterior threaded mandrel portion at said first anchor mandrel end; and an anchor ring having a threaded ring portion, said anchor ring being contained in said inner ring groove;

a cap member having a first cap end and a second cap end opposite said first cap end, said cap member being engaged with said second anchor mandrel end;

a slip device having a first slip end, a second slip end opposite said first slip end, an outer engagement surface, and a tapered inner surface increasing in diameter to said first slip end, wherein said first cap end faces said second slip end; and a sealing member being mounted around said tapered outer surface, said slip device being between said sealing member and said cap member, wherein said tapered inner surface is in sliding engagement with said tapered outer surface according to said threaded ring portion within said cone in ratchet locked engagement with said exterior threaded mandrel portion, and wherein said anchor mandrel is comprised of a plurality of collet fingers and a collet base, said collet base being on said second anchor mandrel end, the collet fingers extending from said collet base toward said first anchor mandrel end and toward said threaded ring portion in said cone.

2. The frac plug device, according to claim 1, wherein, in a run-in configuration, said threaded ring portion within said cone is at a first ratchet locked position relative to said exterior threaded mandrel portion of said anchor mandrel, said slip device being in an initial position, and said sealing member being in an original position, wherein, in a set configuration, said threaded ring portion within said cone is at a second ratchet locked position relative to said exterior threaded mandrel portion of said anchor mandrel, said slip device being in an extended position, said sealing member being in an expanded position, wherein said first anchor mandrel end is closer to said first cone end in said second ratchet locked position than in said first ratchet locked position, wherein said outer engagement surface is in said extended position so as to set the slip device in a borehole wall, and wherein said sealing member is in said expanded position so as to seal against the borehole wall.

3. The frac plug device, according to claim 2, wherein said cap member exerts pressure against said second slip end so as to prevent release of said slip device from said cone in said set configuration.

4. The frac plug device, according to claim 3, wherein said cap member is comprised of a first cap end surface engaged with said second slip end.

5. The frac plug device, according to claim 1, wherein said anchor mandrel is removably engaged to said cap member, and wherein said cap member is comprised of a cap cavity on said first cap end.

6. The frac plug device, according to claim 5, said second anchor mandrel end being mounted in said cap cavity.

7. The frac plug device, according to claim 1, wherein said exterior threaded mandrel portion is comprised of each exterior collet finger surface of said plurality of collet fingers.

8. The frac plug device, according to claim 1, wherein said anchor ring has a C-shape or annular shape.

9. The frac plug device, according to claim 1, wherein said threaded ring portion covers at least a portion of an inner ring surface of said anchor ring.

10. The frac plug device, according to claim 1, further comprising: a seal support ring between said sealing member and said slip device.

11. A frac plug device, comprising:

a cone having first cone end, a second cone end opposite said first cone end, an inner core extending from said first cone end to said second cone end, and a tapered outer surface decreasing in outer cone diameter toward said second cone end, wherein said inner core is comprised of an inner ring groove closer to said second cone end than said first cone end;

an anchor mandrel assembly attached to said cone, wherein said anchor mandrel assembly is comprised of:

an anchor mandrel having a first anchor mandrel end, a second anchor mandrel end opposite said first anchor mandrel end, and an exterior threaded mandrel portion at said first anchor mandrel end; and an anchor ring having a threaded ring portion, said anchor ring being contained in said inner ring groove;

a cap member having a first cap end and a second cap end opposite said first cap end, said cap member being engaged with said second anchor mandrel end;

a slip device having a first slip end, a second slip end opposite said first slip end, an outer engagement surface, and a tapered inner surface increasing in diameter to said first slip end, wherein said first cap end faces said second slip end;

a sealing member being mounted around said tapered outer surface, said slip device being between said sealing member and said cap member, wherein said tapered inner surface is in sliding engagement with said tapered outer surface according to said threaded ring portion within said cone in ratchet locked engagement with said exterior threaded mandrel portion; and a seal support ring between said sealing member and said slip device, wherein said seal support ring is comprised of a plurality of ring segments, each ring segment of said plurality of ring segments being overlapped with an adjacent ring segment of said plurality of ring segments so as to prevent the sealing member from extruding toward said slip device.

12. The frac plug device, according to claim 11, said seal support ring being expandable, each ring segment of said plurality of ring segments being less overlapped with an adjacent ring segment of said plurality of ring segments as a seal support ring diameter 56 increases.

13. A method of isolating a zone in a wellbore, wherein, in a run-in configuration, said threaded ring portion within said cone is at a first ratchet locked position relative to said exterior threaded mandrel portion of said anchor mandrel, said slip device being in an initial position, and said sealing member being in an original position, wherein, in a set configuration, said threaded ring portion within said cone is at a second ratchet locked position relative to said exterior threaded mandrel portion of said anchor mandrel, said slip device being in an extended position, said sealing member being in an expanded position, wherein said first anchor mandrel end is closer to said first cone end in said second ratchet locked position than in said first ratchet locked position, wherein said outer engagement surface is in said extended position so as to set the slip device in a borehole wall, and wherein said sealing member is in said expanded position so as to seal against the borehole wall, the method comprising the steps of:

deploying the frac plug device, according to claim 11, in said run-in configuration with said anchor ring within said cone and said anchor mandrel at a first ratchet locked position, said slip device in said initial position, and said sealing member in said original position;

moving said threaded ring portion along said exterior threaded mandrel portion from said first ratchet locked position toward a second ratchet locked position closer to said first cone end;

pushing said tapered inner surface along said tapered outer surface with said cap member against said second slip end; and placing said frac plug in said set configuration with said anchor ring within said cone and said anchor mandrel at said second ratchet locked position, said slip device in said extended position, and said sealing member in said expanded position, wherein the step of placing said frac plug device in said set configuration with said anchor ring within said cone and said anchor mandrel at said second ratchet locked position, said slip device in said extended position, and said sealing member in said expanded position further comprises the step of:

expanding said seal support ring so as to prevent the sealing member from extruding toward said slip device.

14. The method of isolating the zone in the wellbore, according to claim 13, further comprising the steps of:

setting said slip device in a borehole wall with said outer engagement surface in said extended position; and sealing said sealing member in said expanded position against said borehole wall.

15. The method of isolating the zone in the wellbore, according to claim 13, wherein said anchor mandrel is comprised of a plurality of collet fingers and a collet base, said collet base being on said second anchor mandrel end, the collet fingers extending from said collet base toward said first anchor mandrel end and toward said cone, and wherein the step of moving said threaded cone portion at said first ratchet locked position toward said second ratchet locked position is comprised of the step of: bending each collet finger and restoring each collet finger.

16. The method of isolating the zone in the wellbore, according to claim 15, wherein said exterior threaded mandrel portion is comprised of each exterior collet finger surface of said plurality of collet fingers.

17. The method of isolating the zone in the wellbore, according to claim 13, wherein the step of expanding is comprised of reducing overlap of each ring segment of said plurality of ring segments with an adjacent ring segment of said plurality of ring segments as a seal support ring diameter increases.

18. The method of isolating the zone in the wellbore, according to claim 13, wherein said tapered outer surface is comprised of a notch between said first cone end and said second cone end, and wherein the step of placing said frac plug device in the set configuration with said anchor ring within said cone and said anchor mandrel at said second ratchet locked position, said slip device in said extended position, and said sealing member in said expanded position further comprises the step of:

engaging said sealing member in said expanded position to said notch.

* * * * *